US006557848B2

(12) United States Patent
Hsiao et al.

(10) Patent No.: US 6,557,848 B2
(45) Date of Patent: May 6, 2003

(54) PAPER-STOPPING MECHANISM OF AUTOMATIC DOCUMENT FEEDER

(75) Inventors: Sidney Hsiao, Changhua (TW); Jones Wu, Yunghe (TW); Jackly Liu, Banchiau (TW); Julian Liu, Taichung (TW)

(73) Assignee: Silitek Corporation (TW)

( * ) Notice: Subject to any disclaimer, the term of this patent is extended or adjusted under 35 U.S.C. 154(b) by 96 days.

(21) Appl. No.: 09/843,479

(22) Filed: Apr. 26, 2001

(65) Prior Publication Data

US 2002/0158407 A1 Oct. 31, 2002

(51) Int. Cl.[7] ..... B65H 1/04

(52) U.S. Cl. ..... 271/245; 271/226; 271/3.02; 270/58.12; 414/789

(58) Field of Search ..... 271/245, 13, 253, 271/233, 254, 3.02, 189, 241, 10.12, 226, 243; 270/58.17, 58.12; 414/788.9, 789

(56) References Cited

U.S. PATENT DOCUMENTS 5,879,000 A * 3/1999 Kakuta ..... 271/3.02
6,032,948 A * 3/2000 Peebles et al. ..... 271/224
6,199,855 B1 * 3/2001 Choeng et al. ..... 271/122
6,361,040 B1 * 3/2002 Itakura ..... 271/164

* cited by examiner

*Primary Examiner*—Frank E. Werner
(74) *Attorney, Agent, or Firm*—Peter F. Corlese; Steven M. Jensen; Edwards & Angell, LLP

(57) ABSTRACT

A paper-stopping mechanism applied in an automatic document feeder (ADF). The paper-stopping mechanism includes a shaft, a stepping motor for carrying the shaft to rotate, a cam structure having a first protruding portion and a second protruding portion and carried by the shaft to rotate the first protruding portion and the second protruding portion thereof, a paper-stopping arm having a bearing point, wherein the bearing point is moved against by the first protruding portion to move the paper-stopping arm upward, and an elastic buckling device for buckling the paper-stopping arm when the paper-stopping arm is moving upward to stay at a paper-feeding position, and for shifting when the second protruding portion of the cam structure is rotated against the elastic buckling device for removing the paper-stopping arm from the elastic buckling device to return to a paper-stopping position.

10 Claims, 6 Drawing Sheets

PAPER-STOPPING MECHANISM OF AUTOMATIC DOCUMENT FEEDER

FIELD OF THE INVENTION

The present invention relates to a paper-stopping mechanism, and more particularly to a paper-stopping mechanism applied in an automatic document feeder for aligning and feeding papers.

BACKGROUND OF THE INVENTION

An automatic paper-feeding function is essential for an office machine such as fax machine, copy machine, printer or scanner. Those machines include an automatic document feeder (ADF) for feeding papers one by one into the machine.

FIG. 1 is a cross-sectional view illustrating an automatic document feeder (ADF) according to the prior art. As shown in FIG. 1, the automatic document feeder includes a base 11, a pick-up roller 12, a guiding plate 13 and a compressed spring 14. When feeding papers, the compressed spring 14 is adjusted according to the thickness of paper and the paper is fed one by one to the guiding plate 13 and further driven into the base 11 via friction between the paper and the pick-up roller 12 for copying, scanning, faxing or printing. Before entering the guiding plate 13, the paper is stopped and aligned by a paper stopper 15. The paper stopper 15 is controlled by an electromagnetic solenoid (not shown) for switching between a paper-stopping position and a paper-feeding position. As shown in FIG. 2A, the paper stopper 15 is at the paper-stopping position and papers 16 are aligned by the paper stopper 15. When the paper stopper 15 is lifted to the paper-feeding position as shown in FIG. 2B, the papers 16 are fed into the automatic document feeder one by one via a gap 17. However, because the paper stopper is driven by the electromagnetic solenoid according to the prior art, it is costly.

Therefore, the purpose of the present invention is to develop a paper-stopping mechanism applied in an automatic document feeder to deal with the above situations encountered in the prior art.

SUMMARY OF THE INVENTION

It is therefore an object of the present invention to propose a paper-stopping mechanism applied in an automatic document feeder for reducing the cost.

It is therefore another object of the present invention to propose a paper-stopping mechanism applied in an automatic document feeder without using any electromagnetic solenoid.

According to the present invention, there is proposed a paper-stopping mechanism applied in an automatic document feeder (ADF). The paper-stopping mechanism includes a shaft, a stepping motor for carrying the shaft to rotate, a cam structure having a first protruding portion and a second protruding portion and carried by the shaft to rotate the first protruding portion and the second protruding portion thereof, a paper-stopping arm having a bearing point, wherein the bearing point is moved against by the first protruding portion to move the paper-stopping arm upward, and an elastic buckling device for buckling the paper-stopping arm when the paper-stopping arm is moving upward to stay at a paper-feeding position, and for shifting when the second protruding portion of the cam structure is rotated against the elastic buckling device for removing the paper-stopping arm from the elastic buckling device to return to a paper-stopping position.

Preferably, the mechanism further includes a one-way clutch disposed between the shaft and the cam structure for providing the cam structure carried by the shaft to rotate in a first direction. Preferably, the shaft carries the one-way clutch to rotate in a second direction when the paper-stopping arm is at the paper-stopping position, the cam structure is caused to rotate in the second direction to be against an end of the elastic buckling device, and the cam structure is stopped to return to an initial position because of a friction between the one-way clutch and the shaft. Preferably, the stepping motor is used to cause the shaft and the cam structure to rotate in the first direction for a fixed angle, and then the paper-stopping arm is moved upward for buckling to stay at the paper-feeding position.

Preferably, the mechanism further includes a base for pivotally connecting the paper-stopping arm to the base, and for fastening the elastic buckling device on the base.

Preferably, the bearing point is a pin. Preferably, the elastic buckling device is a wire spring having a curved point for fastening with the pin of the paper-stopping arm and corresponding with the second protruding portion to rotate against an end of the wire spring to shift for removing the pin of the paper-stopping arm from the curved point and falling down to become the paper-stopping position.

Preferably, the cam structure has an angle between the first protruding portion and the second protruding portion which are alternatively disposed along an axle.

Preferably, the paper-stopping arm includes a first portion and a second portion, and the first portion is pivotally connected to the second portion.

Preferably, the stepping motor is also a stepping motor of the automatic document feeder.

The present invention may best be understood through the following description with reference to the accompanying drawings, in which:

DETAILED DESCRIPTION OF THE PREFERRED EMBODIMENTS

Figure 1:
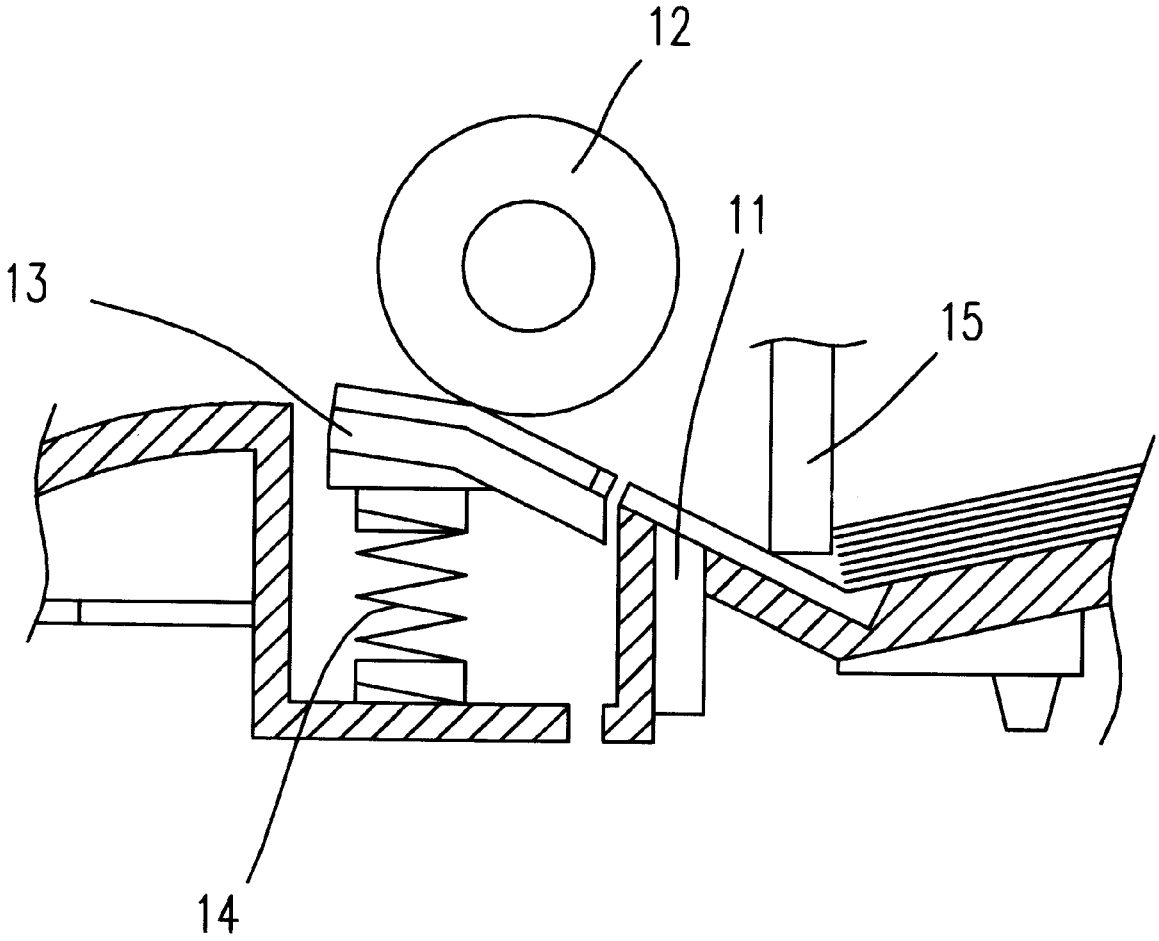
Fig. 1 PRIOR ART
FIG. 1 is a cross-sectional view illustrating an automatic document feeder (ADF) according to the prior art.
Figure 2A:
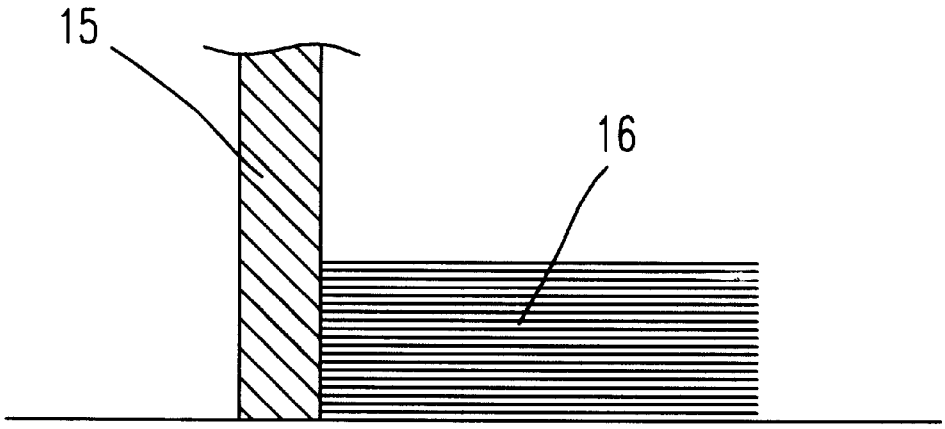
Fig. 2A PRIOR ART
FIGS. 2A–2B are diagrams illustrating a paper stopper switched between a paper-stopping position and a paper-feeding position according to the prior art.
Figure 2B:
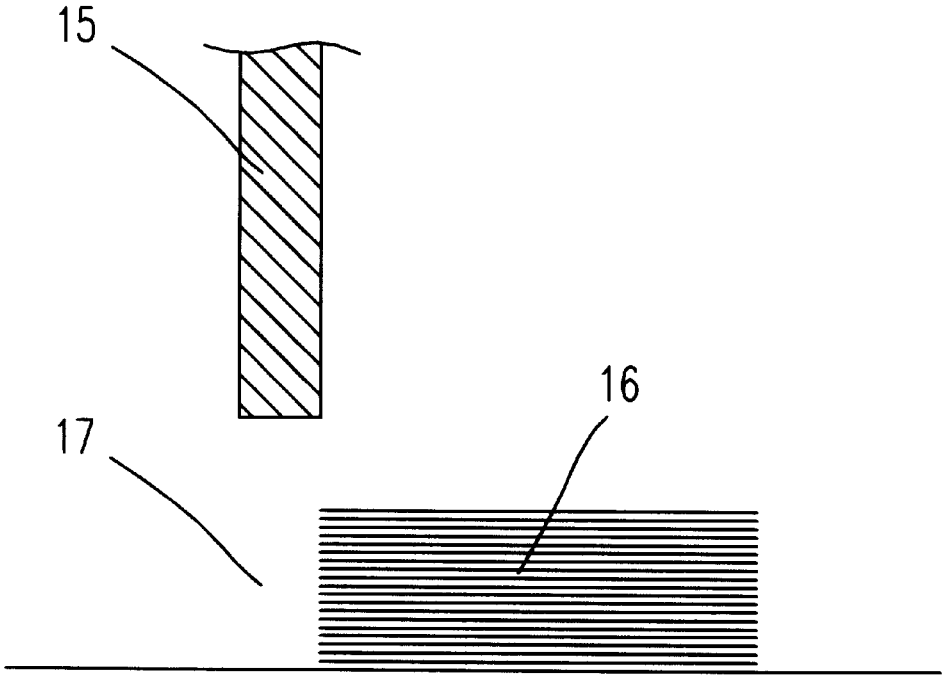
Fig. 2B PRIOR ART
Figure 3A:
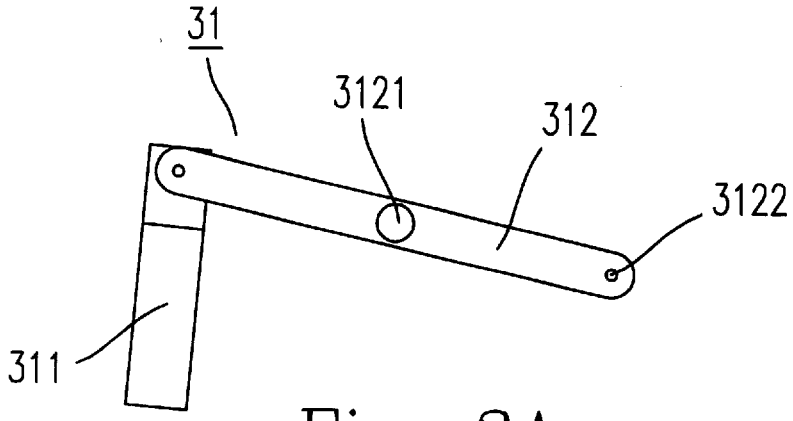
FIGS. 3A–3C are diagrams illustrating composition devices of an automatic document feeder (ADF) according to a preferred embodiment of the present invention.
Figure 3B:
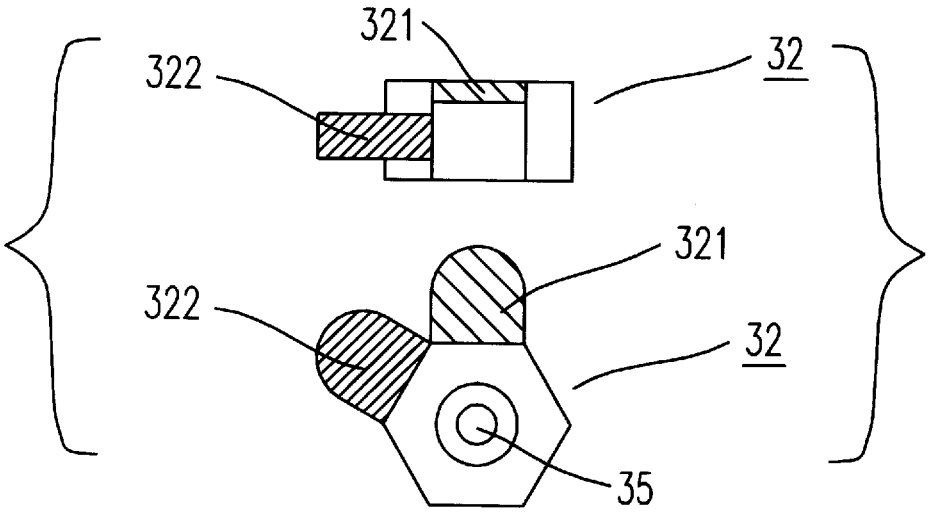
Figure 3C:
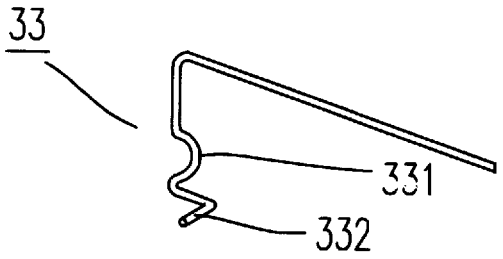

FIGS. 3A–3C are diagrams illustrating composition devices of an automatic document feeder (ADF) according to a preferred embodiment of the present invention. As shown in FIG. 3A, a paper-stopping arm 31 includes a first portion 311 and a second portion 312, wherein the first portion 311 is pivotally connected to the second portion 312.

The second portion 312 has a pin 3121 and a pivot 3122 thereon. FIG. 3B illustrates a top view and a lateral view of a cam structure 32. The cam structure 32 has a first protruding portion 321 and a second protruding portion 322, which are separated at an angle and alternatively disposed along an axle. As shown in FIG. 3C, an elastic buckling device 33, e.g. a wire spring, has a curved point 331 and a folded end 332.

Figure 3D:
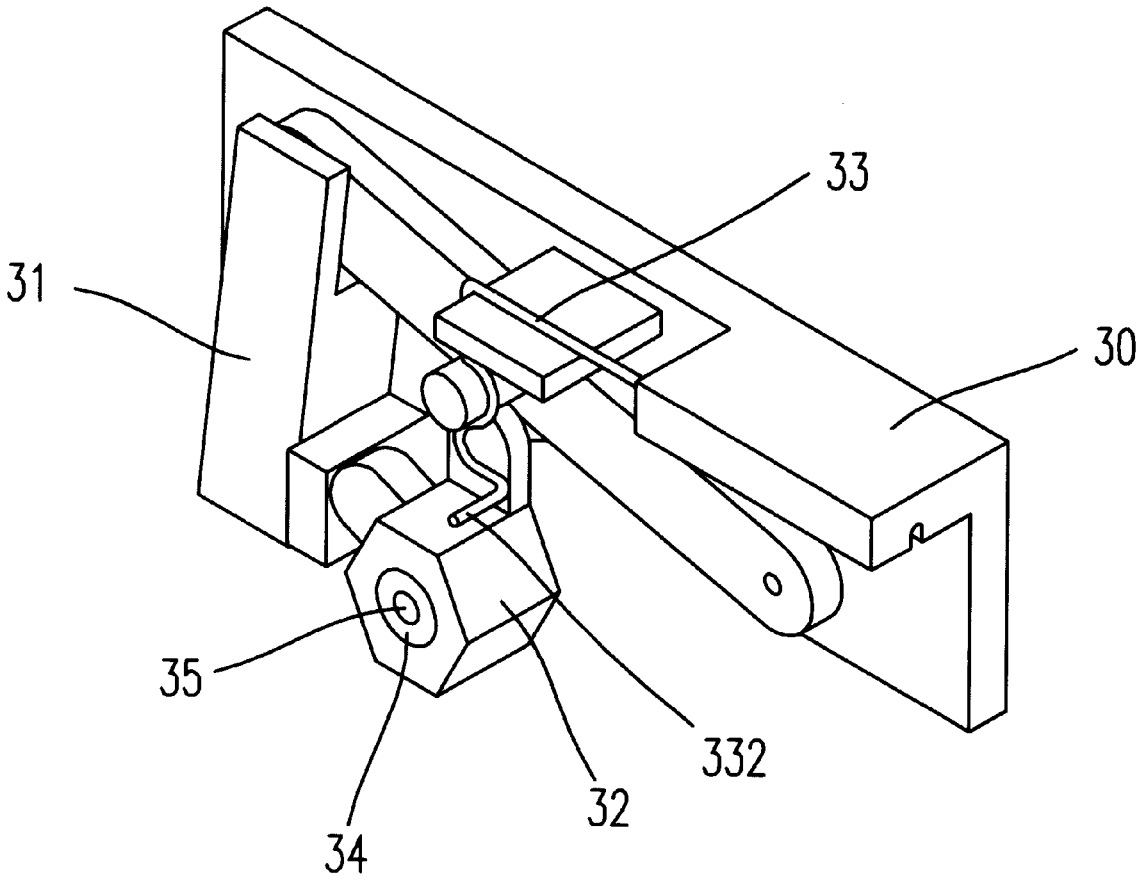
FIG. 3D is a three-dimensional view illustrating the automatic document feeder (ADF) assembled by the composition devices of FIGS. 3A–3C according to the present invention.

FIG. 3D is a three-dimensional view illustrating the automatic document feeder (ADF) assembled by the composition devices of FIGS. 3A–3C according to the present invention. As shown in FIG. 3D, the second portion 312 of the paper-stopping arm 31 is pivotally connected to a base 30 via the pivot 3122, and the elastic buckling device 33, i.e. the wire spring, is fastened on the base 20. The cam structure 32 is connected onto a shaft 35 via a one-way clutch 34, and the shaft 35 is carried by a stepping motor (not shown) to rotate in both directions. The stepping motor can be equipped in the automatic document feeder.

Figure 4A:
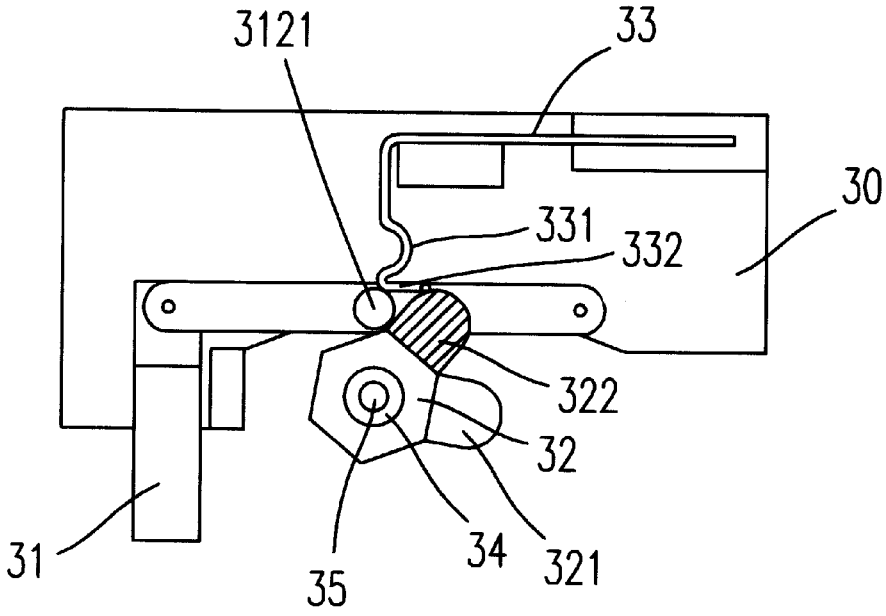
FIGS. 4A–4D are diagrams illustrating a continuous operating condition of the automatic document feeder (ADF) according to a preferred embodiment of the present invention.

FIGS. 4A–4D are diagrams illustrating an automatic document feeder (ADF) under a continuous operating condition according to a preferred embodiment of the present invention. As shown in FIG. 4A, the automatic document feeder is under an initial condition after being turned on. The paper-stopping arm 31 is at a paper-stopping position for stopping and aligning papers, and the cam structure 32 is against the pin 3121 of the paper-stopping arm 311 at an initial position.

Figure 4B:
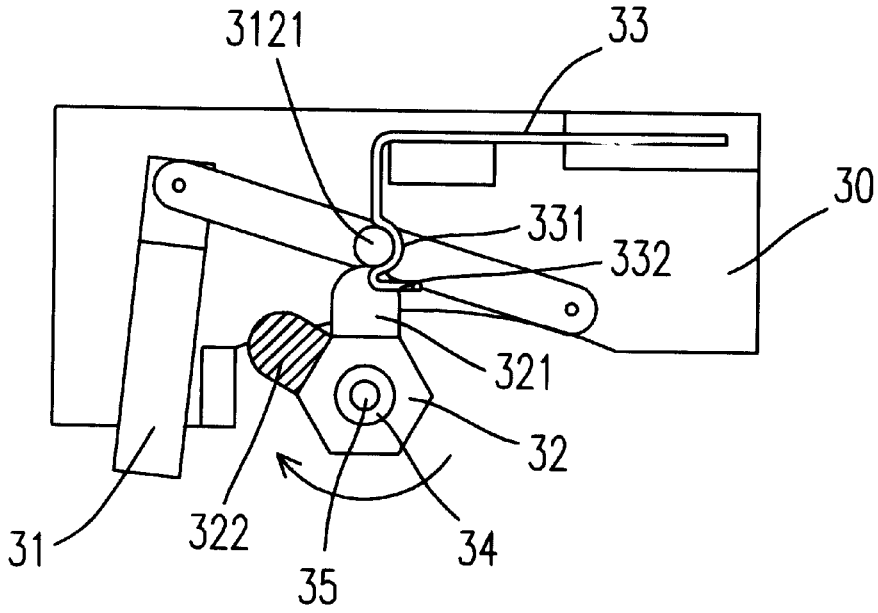

When the automatic document feeder is feeding a sheet of paper, the cam structure 32 is carried by the shaft 35 and the one-way clutch 34 which is driven by the stepping motor (not shown in figure) rotates in a first direction for a certain angle. Sequentially, as shown in FIG. 4B, the first protruding portion 321 of the cam structure 32 is against the pin 3121 of the paper-stopping arm 311 and moves up to buckle with the curved point 331 of the elastic buckling device 33. Thus, the paper-stopping arm 311 is at a paper-feeding position and the automatic document feeder can pick up sheets of paper smoothly.

Figure 4C:
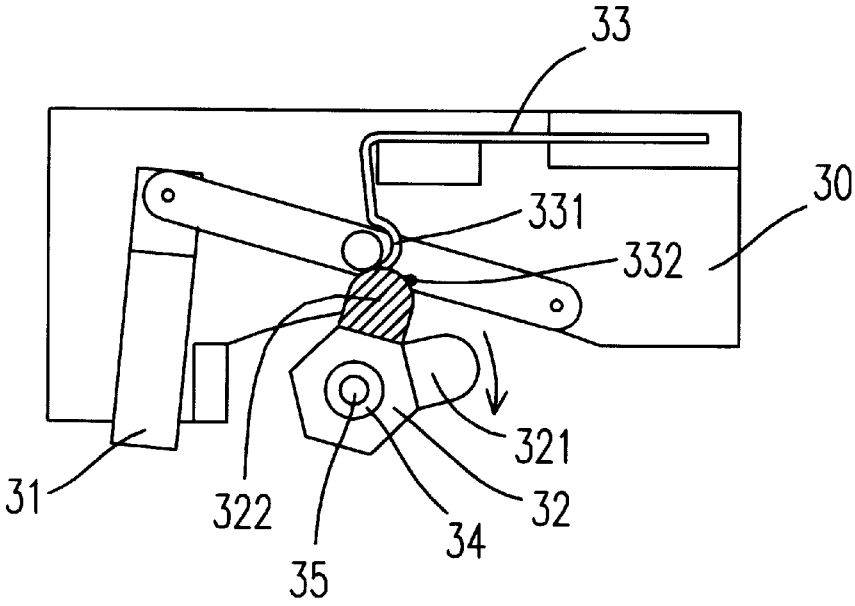

After feeding the paper, the paper-stopping arm returns to a paper-stopping position for stopping and aligning the papers. The cam structure 32 is driven by the stepping motor to rotate a certain angle in the first direction for causing the second protruding potion 322 to move against the folded end 332 of the elastic buckling device 33 to shift as shown in FIG. 4C. Thus, the pin 3121 of the paper-stopping arm 31 is removed from the curved point 331 and falls down to return to the paper-stopping position as shown in FIG. 4D.

Figure 4D:
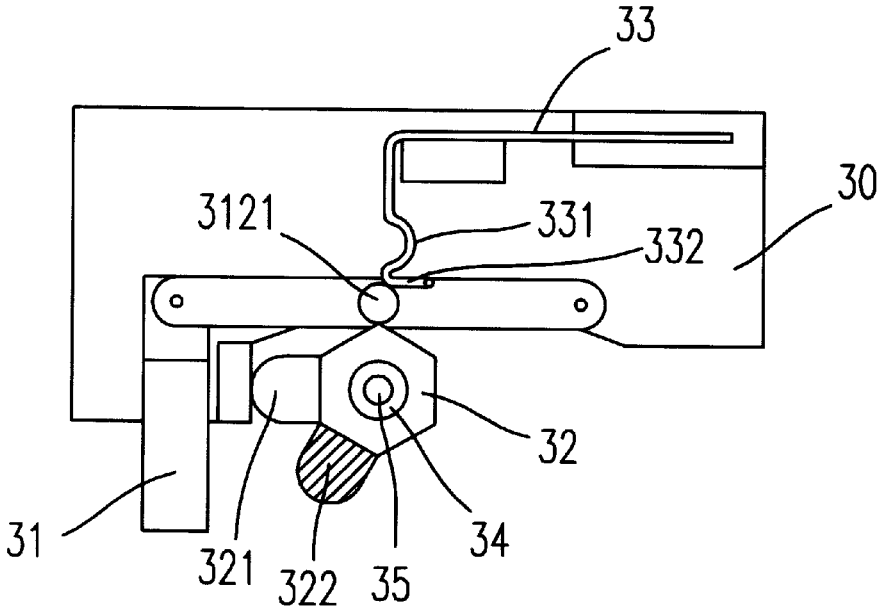

For returning the condition of FIG. 4D to that of FIG. 4A, the shaft 35 is carried by the one-way clutch 34 to rotate in a second direction. Because of the slight friction between the one-way clutch 34 and the shaft 35, the cam structure 32 is caused to rotate in the second direction to be moved against the folded end 332 of the elastic buckling device 33. Thus, the cam structure 32 stops rotating and returns to the initial position even though the shaft 35 is still driven by the stepping motor (not shown in figure) to rotate.

In sum, the paper-stopping mechanism applied in the automatic document feeder according to the present invention can reduce the cost comparing with the prior art because the electromagnetic solenoid is not required.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper-stopping mechanism applied in an automatic document feeder (ADF), comprising:

a shaft;

a stepping motor for causing said shaft to rotate;

a cam structure having a first protruding portion and a second protruding portion and carried by said shaft to rotate said first protruding portion and said second protruding portion thereof;

a paper-stopping arm having a bearing point, wherein said bearing point is moved against said first protruding portion to move said paper-stopping arm upward; and an elastic buckling device for buckling said paper-stopping arm when said paper-stopping arm is moving upward to stay at a paper-feeding position, and for shifting when said second protruding portion of said cam structure is rotated against said elastic buckling device for removing said paper-stopping arm from said elastic buckling device and return to a paper-stopping position.

2. The mechanism according to claim 1, further comprising a one-way clutch disposed between said shaft and said cam structure for causing said cam structure carried by said shaft to rotate in a first direction.

3. The mechanism according to claim 2, wherein said shaft causes said one-way clutch to rotate in a second direction when said paper-stopping arm is at said paper-stopping position, said cam structure is caused to rotate in said second direction against an end of said elastic buckling device, and said cam structure is stopped to return to an initial position because of a friction between said one-way clutch and said shaft.

4. The mechanism according to claim 3, wherein said stepping motor causes said shaft and said cam structure to rotate in said first direction for a fixed angle, and then said paper-stopping arm is moved upward for buckling to stay at said paper-feeding position.

5. The mechanism according to claim 1, further comprising a base for pivotally connecting said paper-stopping arm to said base, and for fastening said elastic buckling device on said base.

6. The mechanism according to claim 1, wherein said bearing point is a pin.

7. The mechanism according to claim 6, wherein said elastic buckling device is a wire spring having a curved point for fastening with said pin of said paper-stopping arm and corresponding with said second protruding portion to rotate against an end of said wire spring to shift for removing said pin of said paper-stopping arm from said curved point and falling down to become said paper-stopping position.

8. The mechanism according to claim 1, wherein said cam structure has an angle between said first protruding portion and said second protruding portion which are alternatively disposed along the shaft.

9. The mechanism according to claim 1, wherein said paper-stopping arm comprises a first portion and a second portion, and said first portion is pivotally connected to said second portion.

10. The mechanism according to claim 1, wherein said stepping motor is also a stepping motor of said automatic document feeder.

* * * * *